US009414979B2

(12) United States Patent
Davis

(10) Patent No.: US 9,414,979 B2
(45) Date of Patent: Aug. 16, 2016

(54) HEEL SUPPORT DEVICE FOR CIRCULATION IMPROVEMENT

(71) Applicant: William Davis, Lynchburg, VA (US)

(72) Inventor: William Davis, Lynchburg, VA (US)

( * ) Notice: Subject to any disclaimer, the term of this patent is extended or adjusted under 35 U.S.C. 154(b) by 0 days.

(21) Appl. No.: 14/496,938

(22) Filed: Sep. 25, 2014

(65) Prior Publication Data

US 2015/0007829 A1 Jan. 8, 2015

Related U.S. Application Data

(63) Continuation-in-part of application No. 12/831,723, filed on Jul. 7, 2010, now abandoned.

(51) Int. Cl.

| | |
|---|---|
| ***A61G 7/075*** | (2006.01) |
| ***A47C 16/02*** | (2006.01) |
| ***A61G 13/12*** | (2006.01) |
| *A61G 7/057* | (2006.01) |
| *A61G 1/04* | (2006.01) |

(52) U.S. Cl.

CPC ..... *A61G 7/0755* (2013.01); *A47C 16/02* (2013.01); *A47C 16/025* (2013.01); *A61G 7/075* (2013.01); *A61G 13/125* (2013.01); *A61G 13/1245* (2013.01); *A61G 1/04* (2013.01); *A61G 7/057* (2013.01)

(58) Field of Classification Search

CPC ..... A61G 7/00; A61G 7/05; A61G 7/057; A61G 7/0573; A61G 7/065; A61G 7/075; A61G 7/0755; A61G 1/04; A61G 13/12; A61G 13/1245; A61G 13/125; A47C 16/00; A47C 16/02; A47C 16/025

USPC ..... 128/845, 870; 297/423.1, 297/423.14–423.19, 423.41, 423.4, 423.45; 5/630, 648, 649–651

See application file for complete search history.

(56) References Cited

U.S. PATENT DOCUMENTS

| | | | | |
|---|---|---|---|---|
| 3,145,397 A * | 8/1964 | Liftman | ..... | A61G 7/0755 248/349.1 |
| 6,935,697 B2 * | 8/2005 | Conlon | ..... | A47C 16/02 297/423.41 |

* cited by examiner

*Primary Examiner* — Keri J Nelson

(74) *Attorney, Agent, or Firm* — Kenneth Bower; Lyman Smith

(57) ABSTRACT

The crossing of one's legs while sitting often results in sensations of tingling and discomfort and difficulty in returning to an erect position and walking. The underlying causes of these sensations are often associated with serious health conditions due to the potential of losing balance and falling as well as formation of blood clots in the legs that can lead to premature death. A support device and associated methods for use alleviate the symptomatic effects of sitting with crossed legs by supporting the heels of the user in a position that separates the legs from mutual contact or contact with the surfaces of the support device.

18 Claims, 3 Drawing Sheets

Section "G - G"

Section "D - D"

Section "G - G"

Section "D - D"

HEEL SUPPORT DEVICE FOR CIRCULATION IMPROVEMENT

CROSS-REFERENCE TO RELATED APPLICATION

This application is a continuation-in-part of U.S. patent application Ser. No. 12/831,723, filed Jul. 7, 2010, the contents of which are herein incorporated by reference.

BACKGROUND OF THE INVENTION

The present invention represents a significant step forward in the field of preventive devices promoting health, particularly for seniors who prefer sitting with their legs crossed. The present invention provides for support of one heel in a comfortable position and supports the heel of the crossed leg at an elevated level where the legs are separated and the remainder of the leg is not contacted by the support device. The present invention is uniquely dedicated to positively supporting and horizontal positioning of the heel to provide vertical space between crossed legs, preventing inadvertent leg contact as well as providing height adjustability and convertibility back to use as conventional furniture.

Numbness in the legs after prolonged crossed leg sitting is associated with falling and the tingling sensation is associated with reduced circulation that can promote the formation of blood clots. There are numerous calf supports addressing medical conditions where one or both calves are supported at a single level having non-functional second levels.

The patent to Kelly (U.S. Pat. No. 621,098) discloses an apparatus that supports two feet or legs on a cushioned surface has a total length of the apparatus for support of the heels is supported by a floor supported structure with adjusted elevation by mechanical adjustment.

The patent to Kelly (U.S. Pat. No. 621,098) lacks disclosure of an apparatus that supports a top heel and a bottom heel thereby preventing contact between crossed legs and lacks a user sitting with crossed legs and further lacks center lower surface an upper left and right side surfaces and further lacks raised portions on both top cushions to avoid heel sliding and also lacks lower heel positions lying under the top cushioned surfaces, it further lacks support on an existing leg support appliance and further lacks supporting the bottom heel on the appliance as well lacks a top cushion with adjusted elevation by manual exchange of cushions, and further lacks power driven adjustment, and further lacks remotely controlled adjustment and lacks becoming an essentially flat surface when the top cushions are in the retracted position and also lacks control of the slope of the cushioned surfaces.

The patent to Shminisu (US 2003/0006639) discloses an apparatus that supports both legs and is supported on an existing leg support appliance and manually controls the slope of the cushioned surfaces.

The patent to Shminisu (US 2003/0006639) lacks an apparatus that supports a top heel and a bottom heel of a user sitting with crossed legs and lacks center lower surface and an upper left and right side surfaces with raised portions on both top cushions to avoid heel sliding, Shminisu further lacks lower heel positions lying under the top cushioned surfaces, it lacks a total length of the apparatus for support of the heels it further lacks support by a floor supported structure it lacks adjustment elevation by manual exchange of cushions, and further lacks mechanical adjustment, power driven adjustment, remotely controlled adjustment and further lacks an essentially flat surface when the top cushions are in the retracted position.

The patent to Spann (U.S. Pat. No. 3,946,451) discloses an apparatus that supports a top leg of a user with center lower surface an upper left and right side surfaces that is supported by an existing leg support appliance.

The patent to Spann (U.S. Pat. No. 3,946,451) lacks an apparatus that supports a bottom heel of a user sitting with crossed legs and lacks an upper left and right side surfaces with raised portions on both top cushions to avoid heel sliding, and also lacks lower heel positions lie under the top cushioned surfaces and further lacks a total length of the apparatus for support of the heels is supported by a floor supported structure and further lacks supporting of the bottom heel on the appliance as well as lacks a top cushion with adjusted elevation by manual exchange of cushions mechanical adjustment, it further lacks power driven adjustment, and lacks remotely controlled adjustment and lacks becoming an essentially flat surface when the top cushions are in the retracted position and finally lacks controlling of the slope of the cushioned surfaces.

As can be seen, there is a need for an improved apparatus and method for supporting a user's heels in a legs-crossed configuration that improves circulation and overall user wellness.

SUMMARY OF THE INVENTION

In one aspect of the present invention, a method for supporting a seated user's legs in a crossed-leg position comprises supporting a first heel of a first leg of a seated user on a leg support appliance; and supporting a second heel of a second leg of the seated user on a support device, wherein the second leg of the seated user is crossed over top the first leg, wherein the second leg does not contact the first leg when the second heel is supported on the support device and the first leg is disposed on the leg support appliance.

In another aspect of the present invention, a method for improving leg circulation in a seated user's legs in a crossed-leg position comprises supporting a first heel of a first leg of a seated user on a leg support appliance; and supporting a second heel of a second leg of the seated user on a support device, wherein the second leg of the seated user is crossed over top the first leg, wherein the second leg does not contact the first leg when the second heel is supported on the support device and the first leg is disposed on the leg support appliance.

In a further aspect of the present invention, a method for improving leg circulation in a seated user's legs in a crossed-leg position comprises supporting a first heel of a first leg of a seated user on a leg support appliance; supporting a second heel of a second leg of the seated user on a support device, wherein the second leg of the seated user is crossed over top the first leg; and adjusting a height of the support device relative to the leg support appliance such that the second leg does not contact the first leg when the second heel is supported on the support device and the first leg is disposed on the leg support appliance, wherein the support device supports the second heel without contact with the first leg and the second leg of the user.

As used herein, the term "leg support appliance" may refer to a foot rest, hassock, or the like. In other embodiments, the "leg support appliance" may simply refer to a portion of a device that supports a user's leg. For example, the support device may include a bridge joining left and right side heel supports. The bridge may be a "leg support appliance" within the scope of the present invention. This specific example is shown in FIGS. 3*a* through 3*e*. In this embodiment the entire structure may rest upon another structure to provide the proper height, or may, itself, include a structure to allow adjustment to the proper height for use.

The present invention is a device that separates the crossed legs of a sitting or reclining person from mutual contact or contact with the device itself. This is accomplished by support of the user's heels. Generally, the instant invention solves the problem of a tingling, pain or numbness in the lower extremities that can lead to falling when attempting to walk or loss of blood circulation that can result in blood clots. Raised cushioned surfaces on either side of a lower cushioned surface appropriately located to achieve separation and with means to keep the top heel from slipping off of the cushion are among the many features to achieve comfort and prolong the period before serious affects become an issue.

It is an object of the present invention to provide an apparatus that supports a top heel and a bottom heel for comfort of a user sitting or reclining with crossed legs.

An additional object of the present invention is to provide a center cushioned surface for supporting a heel of a bottom leg of the crossed legs as well as left side and right side cushioned surface for supporting a left and a right heel of the crossed legs.

An additional object of the present invention is to provide raised portion on the left and right side cushioned surfaces for resistance to sliding of the user's heels placing the crossed legs in contact with each other.

A further object of the present invention is to provide a center cushioned surface that allows the lower heel to rest in a position under a portion of the left side cushioned surface or the right side cushioned surface for comfort.

A further object of the present invention is to provide an apparatus being sufficient length for support of the heels and not taking up the space of a support apparatus for a full leg or a calf portion of a leg.

A further object of the present invention is to provide a customizable heel support by adjustability of the outer cushioned surfaces.

A further object of the present invention is to provide an apparatus that is supported by a separate leg support appliance where the center cushioned surface is the top surface of the separate leg support appliance.

A further object of the present invention is to provide a heel support that includes a floor supported structure.

A further object of the present invention is to provide a heel support apparatus that includes a height adjustment is made by manual exchange of cushions.

A further object of the present invention is to provide a heel support apparatus that includes a height adjustment is made by mechanical adjustment of cushioned surfaces.

A further object of the present invention is to provide a heel support apparatus that includes a height adjustment that is power driven.

A further object of the present invention is to provide a heel support apparatus that includes a height adjustment that is controlled remotely.

A further object of the present invention is to provide a heel support apparatus that includes a height adjustment that also controls a slope of the cushioned surfaces.

A further object of the present invention is to provide an essentially flat surface when the outer heel support cushions are adjusted into a retracted position.

A further object of the present invention is to provide a heel support apparatus that supports the user's heels in a leg-crossed position while keeping the upper leg raised above the lower leg and while keeping the hip level several inches, such as from 1 to 5 inches, above the foot rest which the upper heel rests. In this exemplary embodiment, the upper leg of the crossed legs can be slightly sloped downward when the user is sitting.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a support device and method that reduces or eliminates the sensations of tingling and discomfort that often results while sitting with one's legs crossed. This sitting position can also result in difficulty in returning to an erect position and walking. The underlying causes of these sensations are often associated with serious health conditions due to the potential of losing balance and falling as well as formation of blood clots in the legs that can lead to premature death. The support device and methods of the present invention alleviates the symptomatic effects of sitting with crossed legs by supporting the heels of the user in a position that separates the legs from mutual contact or contact with the surfaces of the support device.

Figure 1A:
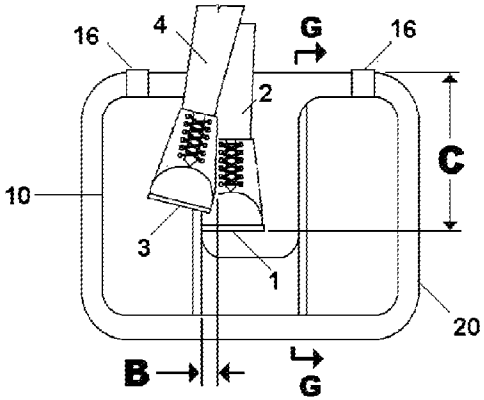
FIG. 1*a* is a top view of a support device, in use, according to an exemplary embodiment of the present invention.
Figure 1B:
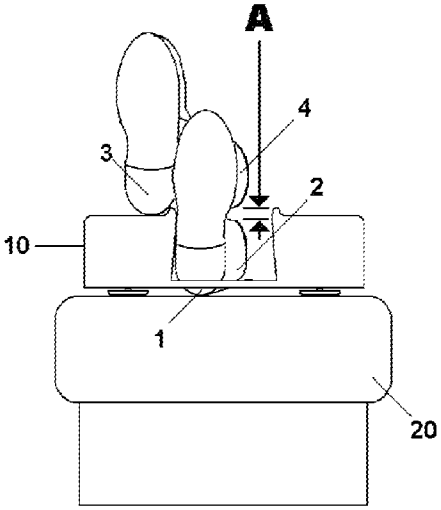
FIG. 1*b* is a front view of the support device of FIG. 1*a;*
Figure 1C:
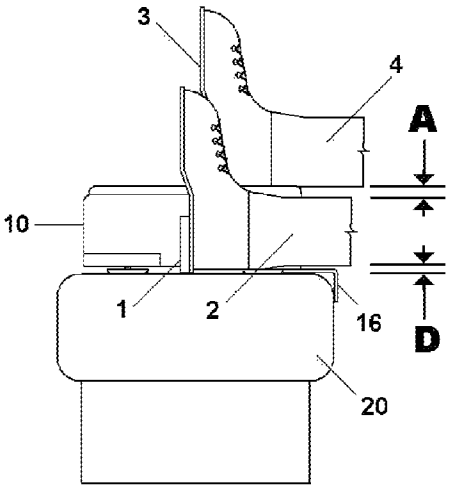
FIG. 1*c* is a cross-sectional view of the support device of FIG. 1*a* taken along line G-G of FIG. 1*a;*

FIGS. 1*a*, 1*b* and 1*c*, showing a support device 10, supported by a leg support appliance, such as a hassock 20, illustrate the seven concepts embodied in the present invention, which are as follows:

1. Separate a person's crossed legs 2 and 4 by means of supporting their heels 1 and 3 a small distance labeled (A) at FIGS. 1*b* and 1*c;*

2. Provide an easy way to adjust the distance (A) for variations in the size of the user's feet and legs;

3. Position the person's top heel 3 to a horizontal position overlapping their bottom heel 2 shown as distance (8) at FIG. 1*a;*

4. Prevent a person's top heel from slipping off of the support surfaces 11 or 12 thereby preventing an impact of the person's upper leg onto the person's lower leg;

5. Separate a person's lower leg 2 from support 20 by controlling the position of the lower heel (C) of FIG. 1*b* which results in a separation between the leg and the leg support by a distance (D);

6. Position the person's upper leg as a slight declining slope from their hips to their heel (as shown in FIG. 3*c*, for example); and 7. The present invention is shown supported by a hassock at FIGS. 1*a*-1*e*, for illustration purposes only. It is considered that devices satisfying one or more of the above concepts that are either supported by or built into recliner foot rests, foot stools, ottomans, vehicle seats, aircraft and spacecraft seats, exercise, treatment and therapy equipment or any other foot rest whether for reducing circulation loss or any other purpose are within the spirit of the present invention and therefore within the meets and bounds of the attached set of claims.

Of course, the above seven concepts are exemplary concepts covered by the present invention. The above list is not exclusive of the benefits, features or improvements imparted by the apparatus and methods of the present invention.

Figure 1E:
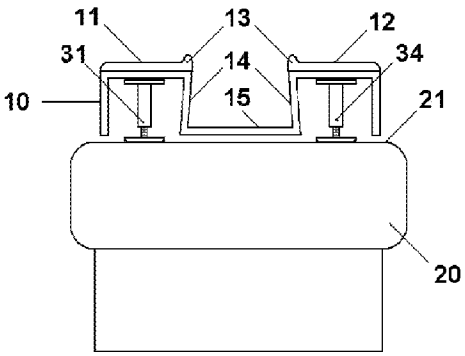
FIG. 1*e* is a cross-sectional view of the support device of FIG. 1*d,* taken along line D-D of FIG. 1*d;*
Figure 1D:
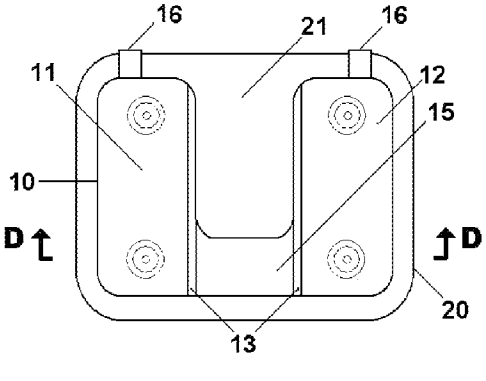
FIG. 1*d* is a top view of the support device of FIG. 1*a*, illustrating the mechanics of the present invention.
Figure 2:
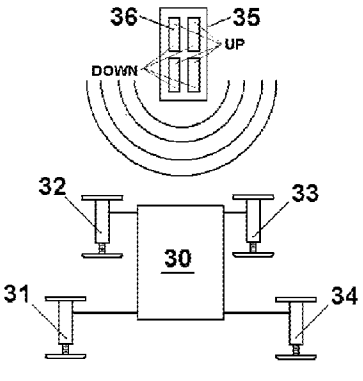
FIG. 2 is a schematic representation of the electrical components and controls of the support device according to an exemplary embodiment of the present invention.

FIGS. 1*d*, 1*e* and FIG. 2 illustrate an exemplary embodiment describing how to make the instant invention. The apparatus 10 includes two elevated heel rest surfaces 11 and 12 and a third heel rest surface 21 that supports the entire apparatus. The elevated surfaces 11 and 12 can be cushioned and can include a raised portion 13 on the inside edges. Vertical walls 14 extend downward, typically at an incline, from the raised edges 13 and end at bridge 15. Raised edges 13 prevent the upper heel 3 from slipping off of the heel support surface 11 which can cause a painful impact with the lower leg 2. Bridge 15 holds heel support surfaces 11 and 12 in the same relative position regardless of any movement of the apparatus 10 with respect to the support 20. Actuators 31-34 can be manually adjusted to raise and lower the entire device or they can be used to tilt the entire device for the user's comfort. Guides 16 contact the edge of the support 20 to properly position the apparatus 10 in the horizontal plane (un-shown).

FIG. 2 shows the apparatus providing easy adjustment of the apparatus to variations in the size of the user by means of actuators 31-34 that extend and contract in length under the control of controller 30. Controller 30 receives wireless, infrared or other signals from a hand held device 35 that has height control switches 36. The controller output conveys appropriate power and or signals to the actuators that cause the actuators to increase or decrease their length thereby adjusting the height of the elevated surfaces.

Figure 3:
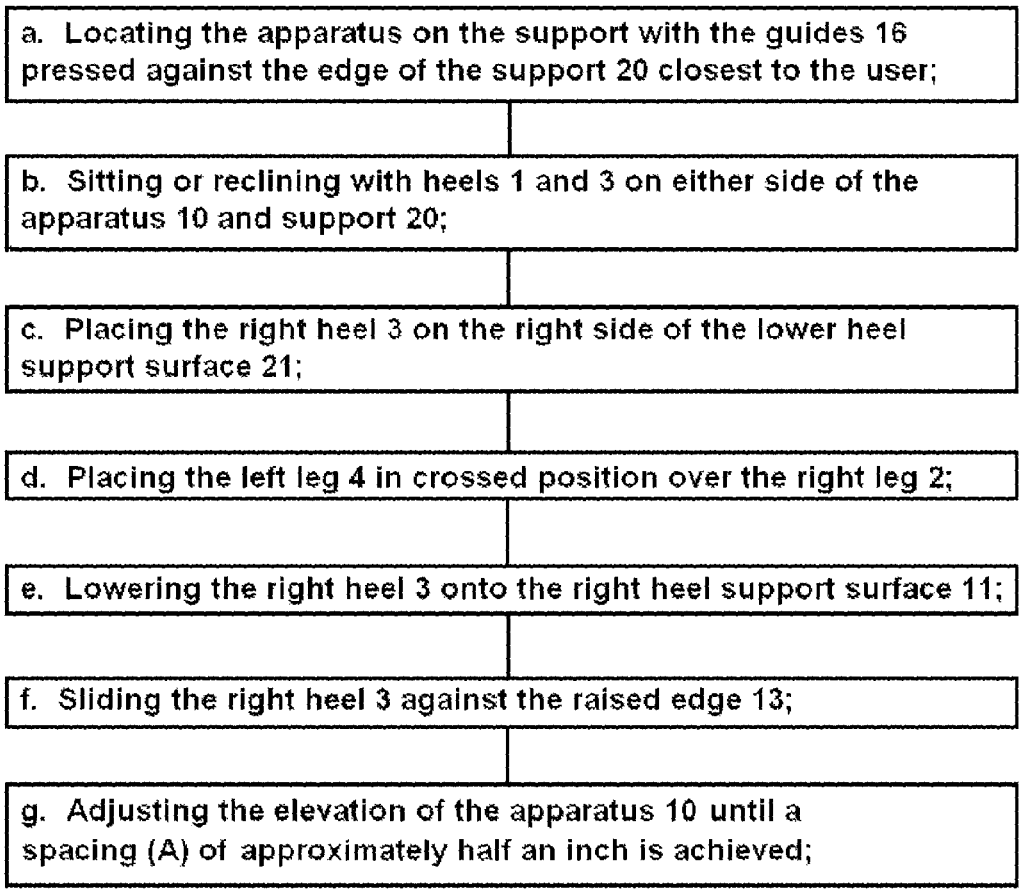
FIG. 3 is a block diagram of a method of use of the support device according to an exemplary embodiment of the present invention.
Figure 3A:
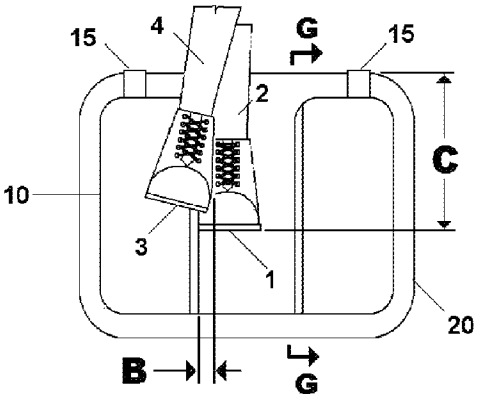
FIG. 3*a* is a top view of a support device, in use, according to another exemplary embodiment of the present invention.
Figure 3B:
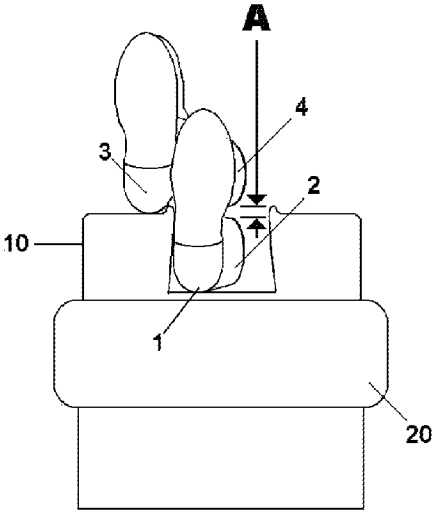
FIG. 3*b* is a front view of the support device of FIG. 3*a;*
Figure 3C:
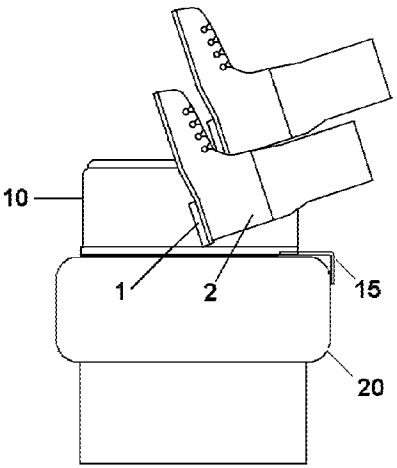
FIG. 3*c* is a cross-sectional view of the support device of FIG. 3*a* taken along line G-G of FIG. 3*a;*
Figure 3D:
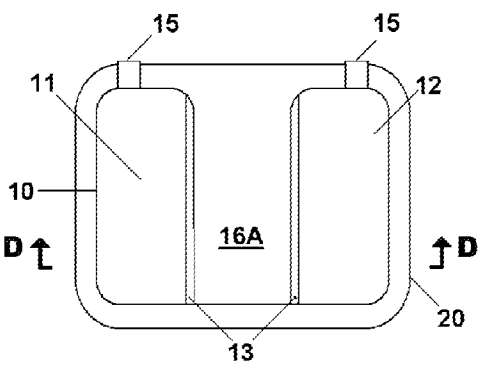
FIG. 3*d* is a top view of the support device of FIG. 3*a*, illustrating the mechanics of the present invention.
Figure 3E:
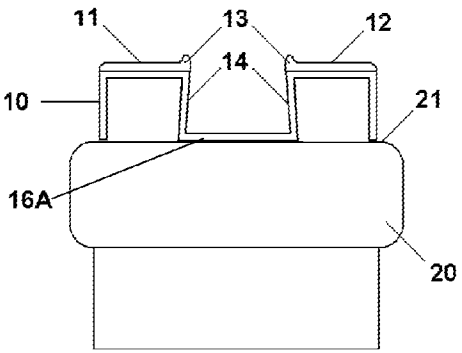
FIG. 3*e* is a cross-sectional view of the support device of FIG. 3*d*, taken along line D-D of FIG. 3*d.*

FIG. 3 outlines exemplary steps of using the apparatus of the instant invention. The steps, outlined below, may be, as appropriate, performed in any order. Some of the below steps may not be required for use of the apparatus of the present invention. Additional steps may further be contemplated within the scope of the present invention. The exemplary steps include the following:

a. Locating the apparatus on the support with the guides 16 pressed against the edge of the support 20 closest to the user;

b. Sitting or reclining with heels 1 and 3 on either side of the apparatus 10 and support 20;

c. Placing the right heel 3 on the right side of the lower heel support surface 21;

d. Placing the left leg 4 in crossed position over the right leg 2;

e. Lowering the right heel 3 onto the right heel support surface 11;

f. Sliding the right heel 3 against the raised edge 13; and g. Adjusting the elevation of the apparatus 10 by use of the switches 36 on remote control 35 until a spacing (A) of approximately half an inch is achieved. This adjustment may result in the upper heal being positioned slightly below (such as from about 1 to about 5 inches below) a horizontal plane defined by the user's hips. In other words, the user's upper leg may be disposed at a slight decline when in a position of use.

It is considered that manual, semi-automatic, automatic, local and alternate remote means of adjusting the height of the apparatus that utilize one or more of the concepts of the instant invention are within the spirit of the invention and within the meets and bounds of the attached claims.

FIGS. 3*a* through 3*e* show an alternate embodiment of the present invention, where a bridge 16A forms a bottom platform joining the left and right side heel supports. In this embodiment, the user may place their lower heel on the bridge 16A while their upper (leg-crossed) heel may be disposed on the heel support structure. Similar to the previous embodiment, when properly adjusted, the user's legs may not press against each other when crossed and supported by the device of the present invention. Moreover, the user's legs may also not press against the device itself, including the bridge and the heel supports.

Although the terms and definitions used in the specification are intended to be read into the claims they are hot intended to limit the meets and bounds of the claims presented here below in any manner whatsoever.

It should be understood, of course, that the foregoing relates to exemplary embodiments of the invention and that modifications may be made without departing from the spirit and scope of the invention as set forth in the following claims.

What is claimed is:

1. A method for supporting a seated user's legs in a crossed-leg position, comprising:

supporting a first heel of a first leg of the seated user on a leg support appliance;

supporting a second heel of a second leg of the seated user on a support device, wherein the second leg of the seated user is crossed over top the first leg; and switching between a left leg as the second leg and a right leg as the second leg without moving the support device by providing the support device with a first heel support and a second heel support, wherein the first leg is disposed between the first heel support and the second heel support, wherein the second leg does not contact the first leg when the second heel is supported on the support device and the first leg is disposed on the leg support appliance.

2. The method of claim 1, wherein the second leg is disposed at a decline towards the leg support appliance relative to hips of the user.

3. The method of claim 1, wherein the support device is disposed upon the leg support appliance.

4. The method of claim 1, wherein the support device is integral with the leg support appliance.

5. The method of claim 1, further comprising supporting the second heel of the user on a cushioned surface disposed on the support device.

6. The method of claim 1, wherein the support device includes a bridge disposed between the first heel support and the second heel support.

7. The method of claim 1, wherein the bridge forms the leg support appliance for supporting the user's first heel.

8. The method of claim 1, wherein the support device includes:

a first wall extending from the first heel support toward the leg support appliance supporting the first leg;

a second wall extending from the right heel support toward the leg support appliance supporting the first leg; and a first distance between the first wall and the second wall measured proximate to the leg support appliance is greater than a second distance between the first wall and the second wall measured distal from the leg support appliance.

9. The method of claim 1, further comprising preventing the second heel from moving horizontally off the support device by providing at least one edge of the support device with a raised surface.

10. The method of claim 1, further comprising adjusting a height of the support device relative to the leg support appliance.

11. The method of claim 1, wherein the support device supports the second heel without contact with the first leg and the second leg of the user.

12. A method for improving leg circulation in a seated user's legs in a crossed-leg position, comprising:

supporting a first heel of a first leg of the seated user on a leg support appliance; and supporting a second heel of a second leg of the seated user on a support device, wherein the second leg of the seated user is crossed over top the first leg, wherein the second leg does not contact the first leg when the second heel is supported on the support device and the first leg is disposed on the leg support appliance; and the support device supports the second heel without contact with the first leg and the second leg of the user.

13. The method of claim 12, wherein the second leg is disposed at a decline towards the leg support appliance relative to hips of the user.

14. The method of claim 12, wherein the support device is integral with the leg support appliance.

15. The method of claim 12, further comprising adjusting a height of the support device relative to the leg support appliance.

16. A method for improving leg circulation in a seated user's legs in a crossed-leg position, comprising:

supporting a first heel of a first leg of the seated user on a leg support appliance;

supporting a second heel of a second leg of the seated user on a support device, wherein the second leg of the seated user is crossed over top the first leg; and adjusting a height of the support device relative to the leg support appliance such that the second leg does not contact the first leg when the second heel is supported on the support device and the first leg is disposed on the leg support appliance, wherein the support device supports the second heel without contact with the first leg and the second leg of the user.

17. The method of claim 16, wherein the support device is disposed upon the leg support appliance.

18. The method of claim 16, wherein the support device is integral with the leg support appliance.

* * * * *